United States Patent [19]

Vilona

[11] Patent Number: 4,603,995

[45] Date of Patent: Aug. 5, 1986

[54] EASEL BINDER

[75] Inventor: James J. Vilona, Campbell, Calif.

[73] Assignee: John S. Fosse, Woodstock, Ill.

[21] Appl. No.: 694,619

[22] Filed: Jan. 24, 1985

[51] Int. Cl.[4] ..... B42D 3/00; B42D 3/16; B42F 13/00

[52] U.S. Cl. ..... 402/73; 402/74; 402/80 R; 281/33

[58] Field of Search ..... 281/33; 402/73, 74, 402/76, 77, 78, 502, 80 R

[56] References Cited

U.S. PATENT DOCUMENTS

| | | | |
|---|---|---|---|
| 1,237,912 | 9/1914 | Klein | 281/33 |
| 1,635,420 | 7/1927 | Johnson | 281/33 |
| 1,979,814 | 1/1933 | Unger | 281/33 |

FOREIGN PATENT DOCUMENTS

| | | | |
|---|---|---|---|
| 147580 | 11/1936 | Austria | 281/33 |

*Primary Examiner*—Robert L. Spruill
*Assistant Examiner*—Taylor J. Ross
*Attorney, Agent, or Firm*—John S. Fosse

[57] ABSTRACT

An easel binder includes hingedly interconnected front cover, back cover and spine panels; and page-mounting means are secured to the inside of one of the two cover panels. A brace, including a swingable medial panel and an end panel hingedly connected to the otherwise free end of the medial panel, is connected to one of the cover panels; and cooperating fasteners are mounted on the end panel of the brace and on a different one of the cover panels so that the cover, back and spine panels can be reversibly configurated into pyramidal form and secured pyramidally so that the binder can be used as an easel.

6 Claims, 3 Drawing Figures

EASEL BINDER

FIELD OF THE INVENTION

This invention relates generally to looseleaf bookbindings and more particularly to snap-ring type binders.

BACKGROUND OF THE INVENTION

Student notebooks and various types of binders for looseleaf professional information services commonly use a snap-ring assembly at the spine for convenience in removing and inserting pages. Snap-ring binders also have the general advantage of lying flat when opened without any substantial propensity to close spontaneously when left unattended.

An important object of the present invention is to incorporate the general advantages of a snap-ring assembly in a book binder which can be set upright in the form of a stable easel for facility in studying the information presented on any one of the contained pages.

A more general object of the present invention is to provide a new and improved looseleaf binder.

Another object of the invention is to provide a looseleaf binder for technical material and the like that can be referred to visually with special ease and with the free use of both hands for other tasks.

These and other objects and features of the invention pertain to the specific structures and arrangements by which the foregoing objects are obtained.

BRIEF DESCRIPTION OF THE DRAWING

The invention, both as to its construction and its mode of use, will be better understood by reference to the following disclosure and drawing forming a part thereof, wherein.

DETAILED DESCRIPTION OF THE INVENTION

Figure 1:
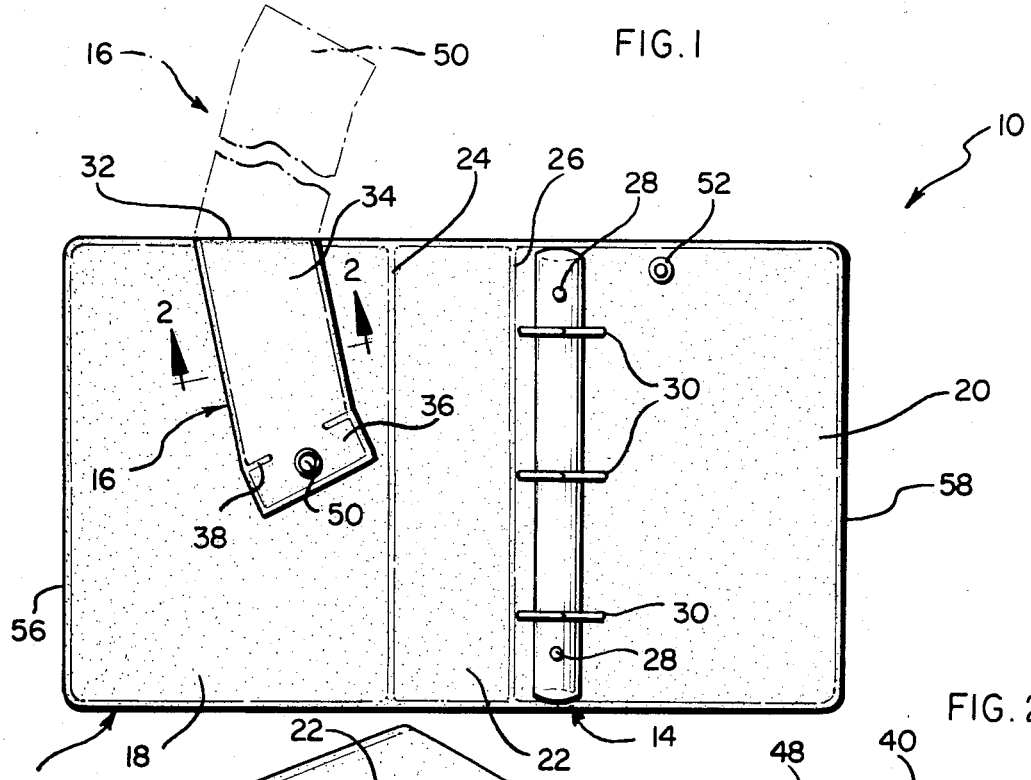
FIG. 1 is a plan view of an easel binder constructed in compliance with the present invention and shown folded out flat and empty of any pages in order to reveal interior constructions.

Referring now in detail to the drawing, specifically to FIG. 1, an empty easel-type ringbinder is shown in FIG. 1 with the cover panels spread flat to reveal the constructional arrangements. The ringbinder 10 comprises a hinged, three-section cover 12; a conventional three-ring snap-ring unit 14; and an integral, swingable brace 16 which is constructed and positioned in compliance with the principles of the present invention.

In the illustrated embodiment, the cover 12 includes a front cover panel 18, a back cover panel 20 and a spine panel 22. The panels 18 and 22 are connected by a flexible hinge 24, and the panels 20 and 22 are joined at a flexible hinge 26 which is aligned parallel with hinge 24. Advantageously, the panels 18, 20 and 22 are fabricated from rigid elements of particle board or paperboard which are enclosed between spaced sheets of flexible vinyl plastic, the plastic sheets being selectively thermally welded to form both the peripheral edges and the flexible hinges 24 and 26.

The snap-ring unit 14 is preferably mounted on the back cover panel 20 parallel with the hinges 24 and 26 by means of spaced rivets 28 and in a position spaced apart fron the hinge 26 in order to facilitate closing of the binder for storage on a bookshelf or the like and to facilitate arranging of the binder 10 in a stable easel-type configuration which will be described hereafter. In the illustrated embodiment, the ring unit 14 conveniently includes three conventional spring-lock, over-centering snap rings 30 which are suitably spaced to accept punched book pages.

Figure 2:
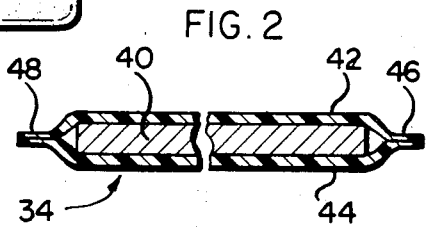
FIG. 2 is an enlarged, cross-sectional view taken substantially along the line 2—2 of FIG. 1.

In compliance with the features of the present invention, the brace 16 is connected to either the top or bottom edge of one of the cover panels, preferably to the front cover panel 18, in angular position and by means of a flexible hinge 32. The brace 16 comprises a rigid, trapezoidal, medial panel 34 and a rigid end panel or tab 36, panels 34 and 36 being joined together at a flexible hinge 38. As shown in FIG. 2, the panel 34 includes a rigid central board 40 which is sandwiched between a pair of flexible vinyl plastic cover sheets 42 and 44 which are thermally welded at edge seams 46 and 48. In addition, the end panel or tab 36 is provided with a first snap fastener element 50 or other suitable, selectively releasible fastener means, in order to co-act with a mating fastener element 52 mounted on the back panel 20 at a suitable distance spaced apart from the ring unit 14. Velcro elements can be readily substituted for the snap fastener elements.

Figure 3:
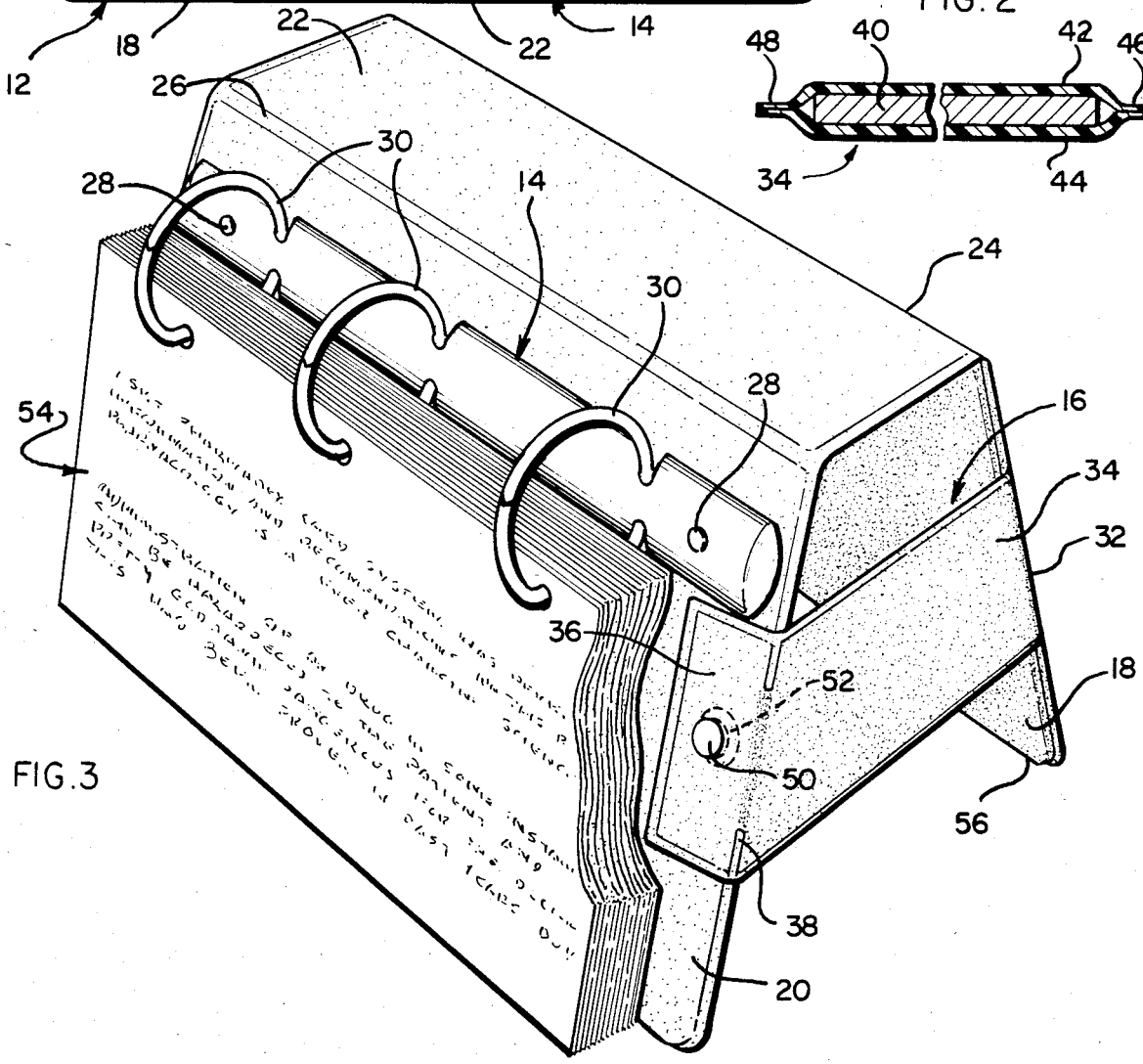
FIG. 3 is an enlarged perspective view of the binder of FIG. 1 set up in its easel configuration and shown containing a quantity of multiply-punched pages fastened in the component snap-ring unit.

As will be appreciated, a suitable number of multiply-punched pages 54 will be mounted in the easel-type binder 10 as is shown in FIG. 3; conveniently, the lines of type or printed material contained on the pages 54 will be disposed parallel with the line of punched holes and with the longitudinal axis of the snap-ring unit 14 for purposes which will appear presently.

In order to configurate the binder 10 in stable pyramidal form so that it may act as an easel, the front panel 18 and the back panel 20 will be opened and reversed generally toward each other to expose the interior of the ring binder, as is shown in FIG. 3. Next, the brace 16 will be swung away from the front panel 18 about the hinge 32, as is suggested in broken lines in FIG. 1, until the trapezoidal panel 34 spans the space between the cover panels 18 and 20. Finally, the fastener elements 50 and 52 will be snaped or otherwise urged into assembled condition in order to secure the easel configuration. As will be appreciated, when the binder 10 is thus configurated, any one of the pages 54 may be selected for viewing, both hands of the viewer thereafter remaining free for other tasks. Pages in advance of the selected page will be merely folded over the snap-ring unit 14 to rest on the confronting surface of spine panel 22 while the succeeding pages will be allowed to suspend from the snap-rings 30. It will also be appreciated that, when the binder 10 is easel-configurated, it is convenient to have the typed or printed text material arranged parallel with the longitudinal axis of the snap ring unit 14.

The drawing and foregoing descriptions are not intended to represent the only forms of the invention in regard to the details of its construction and manner of operation. Changes in form and in the proportion of parts, as well as the substitution of equivalents are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. A binder for books and the like comprising: a rigid front cover panel; a rigid back cover panel; a rigid spine panel hingedly connected to said front cover panel and to said back cover panel; page-mounting means secured to the inside of a selected one of said cover panels; brace means hingedly connected adjacent one of the top and bottom edges of a first one of said cover panels and including a rigid, swingable medial panel of trapezoidal shape and and end panel hingedly connected to the otherwise free end of said medial panel; first fastener means mounted on said end panel; and second fastener means cooperatively, releasibly interengageable with said first fastener means, mounted on the inside surface of a second one of said cover panels, whereby said front, back and spine panels may be reversibly configurated into pyramidal form for use as an easel and said fastener means engaged to preserve said pyramidal form.

2. A binder according to claim 1 wherein said page-mounting means comprises a snap-ring unit.

3. A binder according to claim 1 wherein said selected cover panel is said back cover panel, wherein said first cover panel is said front cover panel and wherein said second cover panel is said back cover panel.

4. A binder according to claim 1 wherein said fastener means are snap fasteners.

5. A binder according to claim 1 which further includes a plurality of pages swingably mounted in said binder by said page-mounting means and printed material on said pages aligned parallel with the longitudinal axis of said page-mounting means.

6. A binder according to claim 1 which further includes flexible plastic sheet means covering said panels and having welded seams defining said hinged connections.

* * * * *